United States Patent [19]
Bodmer et al.
[11] Patent Number: 4,470,058
[45] Date of Patent: Sep. 4, 1984

[54] PRESSURE-SENSITIVE RECORDING SHEET

[75] Inventors: Jerome R. Bodmer, Appleton; John H. Peters, Kaukauna, both of Wis.

[73] Assignee: Appleton Papers Inc., Appleton, Wis.

[21] Appl. No.: 392,868

[22] Filed: Jun. 28, 1982

[51] Int. Cl.[3] ..... B41M 5/22
[52] U.S. Cl. ..... 346/212; 346/207; 346/225; 346/226
[58] Field of Search ..... 282/27.5; 427/150–153; 428/320.4–320.8, 323, 331, 411, 488, 537, 914

[56] References Cited

U.S. PATENT DOCUMENTS 4,154,462 5/1979 Golden et al. ..... 282/27.5
4,239,815 12/1980 Kato et al. ..... 427/150
4,333,984 6/1982 Igarashi et al. ..... 428/336

FOREIGN PATENT DOCUMENTS 1564850 4/1980 United Kingdom ..... 346/210
2068575 8/1981 United Kingdom ..... 346/207

*Primary Examiner*—Bruce H. Hess
*Attorney, Agent, or Firm*—E. Frank McKinney; Paul S. Phillips, Jr.

[57] ABSTRACT

A two-coat record sheet material is disclosed. This record sheet material comprises a base coat comprising an oil-soluble phenol-formaldehyde novolak resin and a topcoat comprising substantially nonreactant pigment material, but no color developer material. The nonreactive topcoat eliminates the accumulation of contaminants on the fuser roll of copier/duplicators produced by prior art record sheet material.

8 Claims, No Drawings

PRESSURE-SENSITIVE RECORDING SHEET

This invention relates to the production of novel record sheet material. More specifically the invention involves the use of a two-coat record sheet material which shows improved performance when utilized in copier/duplicator and high speed laser printer processes.

Pressure-sensitive carbonless copy paper of the transfer type consists of multiple cooperating superimposed plies in the form of sheets of paper which have coated, on one surface of one such ply, pressure-rupturable microcapsules containing a solution of one or more color formers (hereinafter referred to as a CB sheet) for transfer to a second ply carrying a coating comprising one or more color developers (hereinafter referred to as a CF sheet). To the uncoated side of the CF sheet can also be applied pressure-rupturable microcapsules containing a solution of color formers resulting in a pressure-sensitive sheet which is coated on both the front and back sides (hereinafter referred to as a CFB sheet). When said plies are superimposed, one on the other, in such manner that the microcapsules of one ply are in proximity with the color developers of the second ply, the application of pressure, as by typewriter, sufficient to rupture the microcapsules, releases the solution of color former (also called chromogenic material) and transfers color former solution to the CF sheet resulting in image formation through reaction of the color former solution with the color developer. Such transfer systems and their preparation are disclosed in U.S. Pat. No. 2,730,456.

Considerable improvements in the performance of pressure-sensitive carbonless copy paper were realized through the use of certain oil-soluble phenol-formaldehyde novolak resins as the color developer material on the CF sheet. Such resins and their preparation and use are described in one or more of U.S. Pat. Nos. 3,672,935, 3,455,721 and 3,663,256. The use and preparation of certain oil-soluble metal salts of phenol-formaldehyde novolak resins as color developers in pressure-sensitive carbonless copy paper are described in one or more of U.S. Pat. Nos. 3,732,120, 3,737,410, 4,165,102, 4,165,103, 4,166,644 and 4,188,456.

Manifold forms utilizing pressure-sensitive carbonless copy paper are in common commercial use. Most of these forms are produced by processes which utilize conventional printing press techniques. For some applications, however, the production of the multi-part form by photocopying or laser printer operations is preferred. Some of the reasons which can make the production of forms by photocopying or laser printer techniques more attractive are short-run form production, emergencies, experimental or individualized forms and the like. When such carbonless copy paper form production by photocopying techniques is preferred or required, high speed copier/duplicators, such as, for example, the Xerox 9200, the Kodak Ektaprint 150 and the IBM Series III-model 20 copiers, or laser printers, such as, for example, the IBM 3800, are commonly employed for the printing. During such printing of carbonless copy paper comprising oil-soluble phenol-formaldehyde novolak resins as the color developer, such as the compositions disclosed in U.S. Pat. Nos. 3,455,721 and 4,166,644, CF coating components accumulate on the heated fuser roll of the copier or the laser printer. This accumulation becomes tacky and mixed with colored toner particles contaminating the fuser roll. The accumulating contamination on the fuser roll can eventually result in adverse machine runnability and poor copy quality.

A known method utilized to partially overcome the fuser roll contamination problems is to employ a CF sheet sensitized with a phenolic polymeric film material as described in U.S. Pat. No. 3,446,184. While the use of such a sheet minimizes the contamination problem it results in a pressure-sensitive carbonless copying paper which has a slow print development rate (print speed).

It is therefore an object of the present invention to provide pressure-sensitive record material having improved performance when printed in a photocopier or laser printer process.

Another object of the present invention is to provide a pressure-sensitive record material having greatly reduced tendency to contaminate the fuser roll of a photocopy or laser printer machine during a printing process.

Still another object of the present invention is to provide a pressure-sensitive record material having greatly reduced tendency to contaminate the fuser roll of a photocopy or laser printer mchine while the pressure-sensitive record material property of print intensity is maintained at normally acceptable levels.

Yet another object of the present invention is to provide a pressure-sensitive record sheet material comprising a support sheet having bound on the surface thereof a first composition comprising a color developing material selected from the group consisting of an oil-soluble phenol-formaldehyde novolak resin and an oil-soluble metal salt of a phenol-formaldehyde novolak resin, and a second composition comprising substantially nonreactant pigment material bound on the surface of the said first composition.

In accordance with the present invention, it has been found that these and other objectives may be attained by employing a CF sheet which comprises a base coat containing an oil-soluble phenol-formaldehyde novolak resin or an oil-soluble metal salt of a phenol-formaldehyde novolak resin and a topcoat comprising substantially nonreactant pigment material and binder material, but no color developer material. The surprising feature of this invention is that while the non-reactive topcoat eliminates the accumulation of contaminants on the fuser roll, the reactivity of the phenol-aldehyde resin-containing subcoat is maintained as evidenced by the intensity and speed of the print developable thereon. In the context of the present invention, substantially non-reactant pigment material is defined as material which, when contacted with a solution of basic chromogenic material, produces substantially no color.

There is believed to be no known use or disclosure of a two-coat CF sheet wherein a substantially non-reactive pigment-containing topcoat is employed to eliminate the accumulation of contaminants from the reactive layer of a CF sheet on the fuser roll of a copier during a photocopying imaging process. U.S. Pat. No. 4,246,312 discloses the use of an oil-absorptive inorganic material in a subcoat wherein the topcoat is a thermal-sensitive coating comprising a phenol compound. The purpose of such a subcoat is to minimize the release and accumulation of tailings on the printing head of a thermal printer during a thermal printing operation. The use of such a subcoat in CF sheets comprising an oil-soluble metal salt of a phenol-formaldehyde novolak resin as the developer in a topcoat results in just as much contamination on the fuser roll of a photocopier as a prior art CF sheet employing no such subcoat.

A pressure-sensitive recording sheet comprising a coating on a base sheet consisting of an oil-soluble acid reactant polymeric material, a non-reactant pigment and binder material, all said components being distributed within a single coating layer, is disclosed in U.S. Pat. No. 3,617,410.

The composition of the topcoat of the present invention comprises substantially non-reactant pigment material and one or more binders. Preferred among the substantially nonreactant pigments are kaolin clay, calcium carbonate, and calcined kaolin clay. More preferred among the non-reactant pigments is a mixture of kaolin clay and an additional substantially non-reactant pigment selected from the group consisting of calcium carbonate and calcined kaolin clay. Most preferred among the non-reactant pigments is a mixture of kaolin clay and calcium carbonate.

The following examples are given merely as illustrative of the present invention and are not to be considered as limiting. All percentages and parts throughout the application are by weight unless otherwise specified.

EXAMPLE 1

A formulation as listed in Table 1 comprising a zinc-modified p-octylphenol-formaldehyde resin, as disclosed in U.S. Pat. No. 3,737,410, was ground in an attritor at 54% solids.

TABLE 1

| Materials | Parts Dry | Parts Wet |
|---|---|---|
| zinc-modified p-octylphenol-formaldehyde resin | 96.1 | 96.1 |
| dispersant* | 2.9 | 11.6 |
| diammonium phosphate | 1.0 | 1.0 |
| water | — | 76.5 |
| Totals | 100.0 | 185.2 |

*sodium salt of a carboxylate polyelectrolyte.

This resin grind was then used in a CF coating composition as shown below.

| Material | % Dry | Parts Wet |
|---|---|---|
| Resin Grind (From Table 1, 54% solids) | 35.0 | 32.4 |
| Corn Starch Binder (25% solids) | 25.0 | 50.0 |
| Calcined Kaolin Clay | 40.0 | 20.0 |
| Water | — | 147.6 |
| Totals | 100.0 | 250.0 |

The above composition was mixed, applied to a 70 grams per square meter (gsm) base stock and the coating was dried yielding a CF sheet with a dry coat weight of 2.2 gsm.

A top coating composition was then prepared as follows:

| Material | % Dry | Parts Wet |
|---|---|---|
| Kaolin Clay Slurry (68% solids) | 60.0 | 52.9 |
| Calcined Kaolin Clay (U.S. Pat. No. 3,586,523) | 15.0 | 9.0 |
| Corn Starch Binder (25% solids) | 20.0 | 48.0 |
| Styrene-butadiene latex (50% solids) | 5.0 | 6.0 |

-continued

| Material | % Dry | Parts Wet |
|---|---|---|
| Water | — | 84.1 |
| Totals | 100.0 | 200.0 |

The top coating composition was mixed, applied to the above-described CF sheet and the resulting coating was dried yielding a dry topcoat coat weight of 6.5 gsm.

EXAMPLES 2–4

In a similar manner to Example 1, CF coating compositions comprising the resin grind of Table 1 were formulated, mixed, coated and dried. Likewise, top coating formulations were prepared, applied to the respective CF coatings and dried. The materials listed in Table 2 on a % Dry Basis were employed for these coatings:

TABLE 2

| | Subcoat CF Components | | |
|---|---|---|---|
| | Example 2 | Example 3 | Example 4 |
| Resin Grind, % Dry | 30.0 | 30.0 | 30.0 |
| Corn Starch Binder, % Dry | 25.0 | 25.0 | 25.0 |
| Calcined Kaolin Clay, % Dry | 45.0 | 45.0 | 45.0 |
| CF Coat Weight, gsm | 3.7 | 3.4 | 3.7 |
| | **Topcoat Components** | | |
| | Example 2 | Example 3 | Example 4 |
| Kaolin Clay, % Dry | 50.0 | 50.0 | 50.0 |
| Calcium Carbonate, % Dry | 43.5 | 43.0 | 43.0 |
| Polyvinyl alcohol, % Dry | 6.5 | 7.0 | 7.0 |
| Topcoat coat weight, gsm | (A) 5.2; (B) 6.7 | 6.1 | 5.9 |

The topcoat of Example 2 was applied at two different coat weights, resulting in two samples, A and B.

The topcoated CF sheet of Example 3 was further modified by applying the composition given in Table 3 to the uncoated side and drying the coating, resulting in a CFB sheet with a total CB coat weight of 5.3 gsm.

TABLE 3

| Material | % Dry |
|---|---|
| Microcapsules | 74.6 |
| Corn Starch Binder | 4.7 |
| Wheat Starch Particles | 20.7 |

The microcapsules employed above contained a color former solution within capsule walls produced by polymerization methods utilizing monomers of synthetic resins such as those disclosed in U.S. Pat. No. 4,001,140.

EXAMPLES 5–8

In a similar manner to Example 1, four additional examples of two-coat CF sheets were prepared by coating a subcoat, as in Example 2, at a coat weight of 3.7 gsm and top coating the respective topcoats listed in Table 4 at coat weights of 5.9 gsm.

TABLE 4

| | Top Coat Components, % Dry | | | |
|---|---|---|---|---|
| | Example 5 | Example 6 | Example 7 | Example 8 |
| Kaolin Clay | 93.0 | 83.0 | 73.0 | 53.0 |
| Calcium Carbonate | — | 10.0 | 20.0 | 40.0 |
| Polyvinyl | 7.0 | 7.0 | 7.0 | 7.0 |

TABLE 4-continued

| | Top Coat Components, % Dry | | | |
|---|---|---|---|---|
| | Example 5 | Example 6 | Example 7 | Example 8 |
| alcohol | | | | |

In a similar manner to Example 1, a two-coat CF sheet comprising an oil-absorptive inorganic material in a subcoat was prepared as follows to determine the effect on the performance of the resulting CF in a copier/duplicator:

| | |
|---|---|
| Subcoat Components | |
| Calcined Kaolin Clay, % Dry | 80.0 |
| Styrene butadiene latex, % Dry | 8.0 |
| Corn Starch Binder, % Dry | 12.0 |
| Subcoat coat weight, gsm. | 2.2 |
| CF Topcoat Components | |
| Kaolin Clay, % Dry | 64.2 |
| Calcined Kaolin Clay, % Dry | 3.0 |
| Urea-formaldehyde resin pigment, % Dry | 5.2 |
| Resin Grind, % Dry | 12.1 |
| Corn Starch Binder, % Dry | 9.0 |
| Styrene-butadiene latex, % Dry | 6.5 |
| Topcoat coat weight, gsm. | 7.1 |

The CF topcoat formulation is substantially the same as that of Sample A, Table VI, U.S. Pat. No. 4,166,644.

Three comparative CF examples were prepared for testing performance in the copier/duplicators and/or the laser printer. The first two of these are generally disclosed in U.S. Pat. No. 3,732,120 and more specifically disclosed in U.S. Pat. No. 4,166,644. The components listed in Table 5 were employed for the CF coating and applied at a dry coat weight of about 7.4 gsm.

TABLE 5

| | % Dry | |
|---|---|---|
| Components | Example 10 | Example 11 |
| Kaolin Clay | 64.2 | 59.8 |
| Calcined Kaolin Clay | 3.0 | 3.0 |
| Urea-formaldehyde resin pigment | 5.2 | 6.0 |
| Resin Grind | 12.1 | 14.1 |
| Corn Starch Binder | 9.0 | 9.5 |
| Styrene-butadiene latex | 6.5 | 7.5 |
| Sodium salt of a carboxylate polyelectrolyte | — | 0.1 |

The CF sheet of Example 10 was further modified by the application of the composition given in Table 6 to the uncoated side and drying the coating, resulting in a CFB sheet with a total CB coat weight of 5.3 gsm.

TABLE 6

| Material | % Dry |
|---|---|
| Microcapsules | 74.6 |
| Corn Starch Binder | 6.0 |
| Wheat Starch Particles | 19.4 |

The microcapsules employed above contained a color former solution within capsule walls produced by polymerization methods utilizing monomers of synthetic resins such as those disclosed in U.S. Pat. No. 4,001,140.

The third comparative CF examples was prepared by sensitizing a base sheet with a phenolic polymeric film material as described in U.S. Pat. No. 3,466,184. The materials listed below were employed to produce a sensitized CF sheet in a gravure printing operation resulting in a dry coat weight of about 1.3 gsm.

| Materials | Parts |
|---|---|
| Zinc modified phenol-formaldehyde resin | 30.0 |
| Ethylene glycol monomethyl ether | 170.0 |

The CF sheet of Example 12 was further modified by the alternative application of two different compositions to the uncoated side and drying the coating, resulting in two different CFB sheets identified as Examples 12-1 and 12-2. Example 12-2 was produced by coating a composition like that of Table 6, with the exception that the capsule walls comprised synthetic resins produced by polymerization methods utilizing initial condensates as taught in U.S. Pat. No. 4,100,103. Example 12-1 was produced by coating a composition substantially like that of Table 6, with the exception that the capsule walls comprised gelatin and were made in accordance with the procedures described in U.S. Pat. No. 3,041,289.

Each of the CF surfaces of Examples 1 through 12 were tested in a Typewriter Intensity (TI) test with CB sheets comprising a 5.5 gsm. coating of the composition listed in Table 7.

TABLE 7

| Material | % Dry |
|---|---|
| Microcapsules | 81.9 |
| Corn Starch Binder | 3.6 |
| Wheat Starch Particles | 14.5 |

The microcapsules employed contained the color former (basic chromogenic material) solution of Table 8 within capsule walls produced by polymerization methods utilizing monomers of synthetic resins such as those disclosed in U.S. Pat. No. 4,001,140.

TABLE 8

| Material | Parts |
|---|---|
| crystal violet lactone | 1.70 |
| 3,3-bis(1-ethyl-2-methylindol-3-yl) phthalide | .55 |
| 2'-anilino-6'-diethylamino-3'-methylfluoran | .55 |
| benzylxylenes (U.S. Pat. No. 4,130,299) | 34.02 |
| $C_{10}$–$C_{13}$ alkylbenzene | 63.18 |

In the TI test a standard pattern is typed on a CB-CF (or CB-CFB) pair. The reflectance of the typed area is a measure of color development on the CF sheet and is reported as the ratio of the reflectance of the typed area to that of the background reflectance of the CF paper (I/Io), expressed as a percentage. A high value indicates little color development and a low value indicates good color development.

Listed in Table 9 are the TI data for the CF surfaces of Examples 1 through 12 measured 20 minutes after typing.

TABLE 9

| Example | Type | 20 Min. TI |
|---|---|---|
| 1 | CF Example of Invention | 47 |
| 2A | CF Example of Invention | 35 |
| 2B | CF Example of Invention | 37 |
| 3 | CFB Example of Invention | 43 |
| 4 | CF Example of Invention | 40 |

TABLE 9-continued

| E ample | Type | 20 Min. TI |
|---|---|---|
| 5 | CF Example of Invention | 48 |
| 6 | CF Example of Invention | 43 |
| 7 | CF Example of Invention | 40 |
| 8 | CF Example of Invention | 33 |
| 9 | CF Control | 39 |
| 10 | CFB Control | 40 |
| 11 | CF Control | 40 |
| 12-1 | CFB Control | 57 |
| 12-2 | CFB Control | 54 |

It can be observed from Table 9 that the examples which produced the least intense prints were controls 12-1 and 12-2 even though they contained 1.7 to 2.0 times the amount of zinc-modified phenol-formaldehyde resin color developer contained in control examples 11 and 10, respectively.

EXAMPLES 13–24

In a manner substantially the same as Example 8, nine different two-coat CF sheets were prepared wherein nine different pigments were evaluated in a topcoat mixture with kaolin clay. In addition to coating each of the topcoating formulations over the subcoat CF formulation used for Example 8, each of the topcoat mixtures was also coated directly on 70 gsm base stock so that the reactivity of the topcoat mixtures could be measured. Two additional similar examples (Examples 22 and 23) were prepared as above except that 20% rather than 40% of the additional pigment was utilized. Additional kaolin clay was employed to bring the total kaolin clay to 73%. Finally, an example (Example 24) was prepared which was a duplicate of Example 5 and wherein 93% kaolin clay was employed as the sole pigment in the topcoat. Each of the topcoat formulations of Examples 22–24 was also coated directly on 70 gsm base stock. Each of the two-coat CF sheets and corresponding topcoat only samples was evaluated for print intensity in a TI test as described previously. The results are listed in Table 10.

TABLE 10

| Example No. | Second Pigment | % Dry Pigments in Topcoat: Second Pigment | % Dry Pigments in Topcoat: Kaolin Clay | 20 Min. TI: Two Coat CF Sheet | 20 Min. TI: Top-Coat Only |
|---|---|---|---|---|---|
| 13 | Zinc Oxide | 40 | 53 | 34 | 93 |
| 14 | Aluminum Hydroxide | 40 | 53 | 31 | 92 |
| 15 | Barium Sulfate | 40 | 53 | 36 | 93 |
| 16 | Delaminated Kaolin Clay | 40 | 53 | 42 | 92 |
| 17 | Magnesium Silicate | 40 | 53 | 34 | 91 |
| 18 | Crystalline Sodium Aluminiosilicate | 40 | 53 | 37 | 86 |
| 19 | Hydrated Amorphous Silica | 40 | 53 | 30 | 82 |
| 20 | Calcium Carbonate | 40 | 53 | 35 | 92 |
| 21 | Calcined Kaolin Clay | 40 | 53 | 34 | 91 |
| 22 | Calcium Hydroxide | 20 | 73 | 37 | 90 |
| 23 | Urea/Formaldehyde Resin Pigment (U.S. Pat. No. 3,988,522) | 20 | 73 | 30 | 92 |

TABLE 10-continued

| Example No. | Second Pigment | % Dry Pigments in Topcoat: Second Pigment | % Dry Pigments in Topcoat: Kaolin Clay | 20 Min. TI: Two Coat CF Sheet | 20 Min. TI: Top-Coat Only |
|---|---|---|---|---|---|
| 24 | None | 0 | 93 | 55 | 93 |

The TI data demonstrate that all of the above two-coat CF sheets functioned well as record sheets in pressure-sensitive record material and that all of the topcoat only formulations are substantially nonreactive with a solution of basic chromogenic material.

Examples 1 through 4 and 9 through 12 were evaluated for performance in copier/duplicators and/or a laser printer in order to evaluate the examples of the invention and to compare them with the performance of the controls. These results are listed in Table 11.

TABLE 11

Testing of Paper in Copier/Duplicator or Printer

| Example | Tested In | Results |
|---|---|---|
| 1 | Kodak Ektaprint 100 AF Copier | 4000 good copies. No accumulation on fuser roll. |
| 1 | IBM Series III Model 20 Copier | 1050 good copies. No accumulation on fuser roll. |
| 2A | Kodak Ektaprint 150 AF Copier | 1074 good copies. No accumulation on fuser roll. |
| 2B | Kodak Ektaprint 150 AF Copier | 1100 good copies. No accumulation on fuser roll. |
| 3 | IBM 3800 Printer | 2300 good copies. No accumulation along entire length of fuser roll. There was some accumulation at edges corresponding to punch and perf debris and not related to the problem of tacky accumulation containing toner material. |
| 4 | Xerox 9200 Copier | 28000 good copies. No accumulation of toner on fuser roll. |
| 9 | Xerox 9200 Copier | 4000 good copies. Accumulation of toner on fuser roll but not yet enough to affect copy quality. |
| 10 | IBM 3800 Printer | About 2000 copies were made. After about 1000 copies the copy quality began to decline and accumulation of toner on the fuser roll was observed. Double imaging of the copies occurred. |
| 11 | Kodak Ektaprint 150 AF Copier | 335 good copies. Accumulation of toner on fuser roll. |
| 12-1 | Kodak Ektaprint 150 AF Copier | 745 good copies. No accumulation on fuser roll. |
| 12-2 | Kodak Ektaprint 150 AF Copier | 725 good copies. No accumulation on fuser roll. |
| 12-1 | Kodak Ektaprint 100 AF Copier | 932 good copies. No accumulation on fuser roll. |
| 12-2 | Kodak Ektaprint 100 AF Copier | 987 good copies. No accumulation on fuser roll. |

When there was contamination on the fuser roll, e.g. Examples 10 and 11, the buildup was cumulative. In the early parts of the run there was a noticeable darkening of the fuser roll but no adverse effect on copy quality. As the length of the run increased, the accumulation on the fuser roll increased and became tacky and tinted with toner. Severe contamination occurred between 500 and 2000 copies and it was in this interval where adverse effects of the fuser roll contamination on copy quality became noticeable.

Conventional CF paper comprising an oil-soluble metal salt of a phenol-formaldehyde novolak resin produces problems of accumulation of contamination on the fuser roll of all copier/duplicators and printers listed. However, the rate of this accumulation varies with the specific equipment tested. The Xerox 9200 seems to be more resistant to such accumulation and therefor longer runs must be employed to detect the adverse results of the accumulation.

Extended runs (10,000 or more copies) with Examples 12-1 and 12-2 result in slight contamination of the fuser roll but this accumulation did not adversely affect copy quality or machine runnability.

The above data clearly show that a CF sheet which comprises a base coat containing a phenol-aldehyde resin and a topcoat comprising substantially nonreactant pigment and binder material, but no color developer materials, overcomes the problem of contamination of fuser rolls on copier/duplicators and laser printers while providing a satisfactory print intensity as a pressure-sensitive recording sheet.

It is obvious that this invention would also be applicable to self-contained pressure-sensitive record material which comprises an oil-soluble phenol-formaldehyde novolak resin or an oil-soluble metal salt of a phenol-formaldehyde novolak resin as a color developer. In such self-contained pressure-sensitive record material (described in U.S. Pat. No. 4,197,346) the microcapsules containing the chromogenic material and the color developer are arranged on one side of a single support sheet in separate layers. For example, British Pat. No. 1,215,618 discloses such a self-contained record material having a first coat of microcapsules containing a solution of chromogenic material and a top coating comprising a mixture of kaolin clay and an oil-soluble phenol-formaldehyde novolak resin. Such a self-contained record sheet would produce the same fuser roll contamination problems as the previously-described CF sheets when printed in high speed copier/duplicators or laser printers. The application of a topcoat comprising substantially nonreactant pigment material to such a self-contained layer would eliminate fuser roll contamination problems in high speed copier/duplicators or laser printers.

The invention being thus described, it will be obvious that the same may be varied in many ways. Such variations are not to be regarded as a departure from the spirit and scope of the invention and all such modifications are intended to be included within the scope of the following claims.

What is claimed is:

1. A pressure-sensitive record sheet material comprising a support sheet having bound on the surface thereof a first composition comprising a color developing material selected from the group consisting of an oil-soluble, phenol-formaldehyde novolak resin and an oil-soluble metal salt of a phenol-formaldehyde novolak resin, and a second composition comprising substantially nonreactant pigment material bound on the surface of the said first composition.

2. The record sheet of claim 1 wherein the color developing material is an oil-soluble metal salt of a phenol-formaldehyde novolak resin.

3. The record sheet of claim 2 wherein the metal of the metal salt is zinc.

4. The record sheet of claim 1 or 3 wherein the substantially nonreactant pigment material is kaolin clay.

5. The record sheet of claim 4 wherein the nonreactant pigment further includes a material selected from the group consisting of calcined kaolin clay and calcium carbonate.

6. A record material sensitized to receive and to convert to a colored state solutions of colorless chromogenic material applied to it, including, bound on the surface of a supporting web, a first composition comprising an oil-soluble metal salt of a phenol-formaldehyde novolak resin, and a second composition, comprising substantially nonreactant pigment material, bound on the surface of said first composition.

7. The record member of claim 6 in which the substantially nonreactant pigment material includes kaolin clay and a second material selected from the group consisting of calcium carbonate and calcined kaolin clay.

8. The record member of claim 7 in which said second material is calcium carbonate.

* * * * *